United States Patent [19]

Prentice

[11] 3,975,976

[45] Aug. 24, 1976

[54] CUTTING APPARATUS WITH ROTATABLE ANVIL

[76] Inventor: Thomas H. Prentice, 9015 W. 19th Ave., Portland, Oreg. 97219

[22] Filed: Nov. 3, 1975

[21] Appl. No.: 628,576

[52] U.S. Cl. ..... 83/556; 83/561; 83/562; 83/658; 83/700

[51] Int. Cl.[2] ..... B26D 1/06; B27L 5/08

[58] Field of Search ..... 83/561, 556, 557, 658, 83/659, 699, 700

[56] References Cited

UNITED STATES PATENTS

| | | | |
|---|---|---|---|
| 1,236,508 | 8/1917 | Wadhams | 83/556 X |
| 1,676,260 | 7/1928 | Glidden | 83/561 X |
| 2,405,598 | 8/1946 | Miller | 83/561 X |
| 2,690,219 | 9/1954 | Feiertag | 83/526 |
| 3,837,250 | 9/1974 | Lumn | 83/659 X |

*Primary Examiner*—Frank T. Yost
*Attorney, Agent, or Firm*—Kolisch, Hartwell, Dickinson & Stuart

[57] ABSTRACT

Cutting apparatus including an elongate knife shiftable between cutting and noncutting positions, and an elongate anvil having an arcuate striking surface against which the knife may strike. The anvil includes an elongate shaft having an arcuate lower surface which rests in an elongate cradle and is rotatable about its longitudinal axis. The upper surface of the shaft facing the knife has a resilient covering secured thereto. A rotator connected to the anvil is operable to produce random angular incremental rotation of the anvil between cutting strokes of the knife to present different cutting surfaces of the anvil to the knife. The support for the anvil includes a support member having a pair of oppositely facing, angularly disposed surfaces and a pair of holding blocks having angularly disposed surfaces which engage the surfaces of the support member. A screw operatively connected to the holding blocks is operable to urge the holding blocks toward or away from each other to produce raising or lowering of the support member and the anvil resting thereon. The holding blocks also may be shifted in the same direction along the screw means to shift the anvil laterally of the knife.

20 Claims, 6 Drawing Figures

CUTTING APPARATUS WITH ROTATABLE ANVIL

BACKGROUND AND SUMMARY OF THE INVENTION

This invention relates to a rotatable anvil for cutting apparatus, and more particularly to such an anvil which is held in a support by a magnet and includes a rotator which produces random angular incremental rotation of the anvil intermediate cutting strokes of the knife.

In various cutting apparatus, such as veneer clippers which are used to cut veneer into desired lengths, it is common to use an elongate shape-edge knife which is reciprocated toward and away from an anvil. To aid in preservation of the sharp edge on the knife resilient materials may be used on the anvil to produce a striking surface for the edge of the knife.

Previously developed anvils have included those which include an elongate core which is substantially completely covered on its circumferential surfaces by a resilient material. In an attempt to obtain a degree of rigidity in the anvil previous anvils have been in a range from 5 and 6 inches in diameter.

Such previous anvils, although they provide several inches of usable striking surface, present several problems. First is the weight of such an anvil. In the most frequently used clipper size having a 120 inches long anvil for cutting 8 foot veneer, the core would weigh approximately 600 lbs. This presents a problem for maintenance crews since it cannot be easily handled by two men without the aid of hoisting apparatus.

A second problem with such previously developed anvils is that to accommodate full use of the resilient anvil surface, it must be rotated periodically between knife strokes so that a relatively new knife contact is available. Previously developed anvils generally have been supported at their opposite sets of ends by large bearings, or journals, and only intermittently between the bearings by narrow saddle sections. Since the surface of such an anvil becomes roughened due to the cutting of a knife in its striking of the anvil, substantial friction occurs between the anvil and its supportive saddles whereby excessive energy requirements are imposed on the rotator mechanism to produce rotation of the anvil during operation.

Another problem with previous anvils is their stability and firmness. Since previous anvils of this nature have had their total circumference covered with a resilient material this material provides support for the anvil where it rests in the spaced saddle sections. The resilient material will compress when the anvil is struck by the knife and will rebound when the knife retracts, thus causing the entire anvil to rebound toward the knife. This, plus the fact that the support saddles have provided only intermittent support, has produced a certain amount of anvil surface flutter. This, plus the fact that certain combinations of knife strokes may tend to set up harmonic vibrations in the anvil, often produces a variable, rather than a stable anvil surface for the knife to strike against and will produce a less than desirable cutting effect.

A general object of the present invention is to provide a simple and economically constructed anvil which overcomes the disadvantages and problems of previously developed devices as set out above.

More specifically, an object of the invention is to provide cutting apparatus including an anvil, wherein the anvil includes a magnetically attractable element having an arcuate lower surface and a resilient arcuate upper striking surface, and support means for the anvil including a cradle in which the lower surface of the element rests with a magnet therein magnetically attracting the element to hold it in the cradle. With such construction, a relatively lightweight anvil element may be used and the magnet will hold the anvil firmly in the cradle while still permitting rotation of the anvil to present different portions of the striking surface to the knife.

Yet another object is to provide novel cutting apparatus in which the anvil includes an elongate, rigid member resting in direct contact with the supportive surface of the cradle and having a covering of resilient material secured to an upper portion only thereof. With such construction, a resilient striking surface is provided for the knife, while the underside of the element may be firmly supported by the cradle to prevent the previously described undesirable characteristics of previous devices affecting stability and firmness of the anvil during operation.

A still further object of the invention is to provide such cutting apparatus which includes novel rotator means operable to produce random angular incremental rotation of the anvil between cutting strokes of the knife. This provides more even wear of the resilient surface of the anvil producing longer life.

Another object of the invention is to provide a novel, rotatable anvil which is relatively lightweight, yet which is firmly held in direct contact with a supportive cradle throughout a major portion of the length of the anvil to eliminate the problems of rebound and harmonic vibration experienced by previously developed anvils with resilient surfaces.

A still further object is to provide cutting apparatus which includes novel means for adjusting the position of the anvil relative to the knife, whereby the position of the anvil may be finely adjusted and held in selected position relative to the knife.

These and other objects and advantages will become more fully apparent as the following description is read in conjunction with the drawings.

DRAWINGS

DETAILED DESCRIPTION OF AN EMBODIMENT OF THE INVENTION

Figures 1, 6:
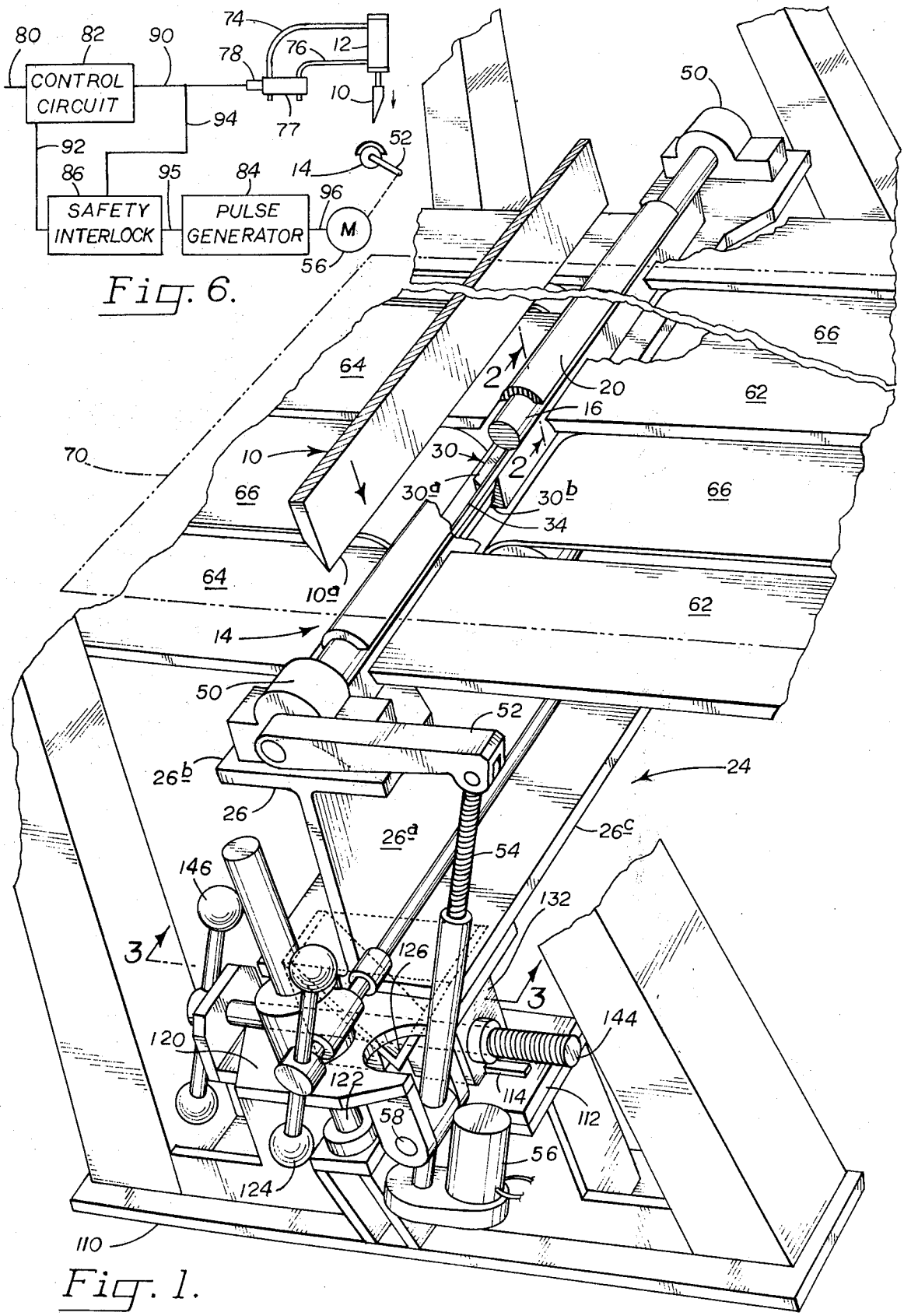
FIG. 1 is a perspective view of cutting apparatus constructed according to an embodiment of the invention, with portions broken away.
FIG. 6 is a simplified schematic illustration of control and operator mechanism for the knife and rotatable anvil in the apparatus.

Referring to FIG. 1, at 10 is indicated generally an elongate clipper knife having a sharpened, elongate, downwardly directed cutting edge 10*a*. The clipper knife is connected to operating mechanism as indicated in FIG. 6, exemplified by a double acting ram 12, for powered reciprocating vertical shifting.

Mounted beneath knife 12 is an elongate anvil indicated generally at 14. The anvil includes an elongate, rigid, magnetically attractable, cylindrical shaft, or element, 16 manufactured of a material such as steel. In the embodiment illustrated for a 120 inches long anvil, shaft 16 may be approximately 3 inches in diameter. An upper arcuate portion of shaft 16 is covered with a resilient material 20, such as a ½ inch covering of polyurethane material of a durometer rating of 97. The anvil is provided with an arcuate lower surface, which is the cylindrical lower portion of the shaft, and an arcuate resilient striking surface provided by material 20 which faces generally in the direction of knife 10 to provide a resilient striking face for the sharp edge of knife 10.

Anvil 14 is supported and held in a position extending substantially parallel to and underlying knife 10 by a support indicated generally at 24. The support includes an elongate, wide flange I-beam 26 which is disposed with its web 26*a* extending vertically and its upper and lower webs 26*b*, 26*c*, respectively, extending substantially horizontal and parallel to the cutting edge of knife 10.

Mounted atop flange 26*b* and secured thereto is an elongate, rigid cradle 30. The cradle has a length which is only slightly less than the overall length of anvil 14 whereby the cradle, as will be described below, may provide a continuous supportive surface extending longitudinally of the anvil throughout a major portion of the length of the anvil.

Figure 2:
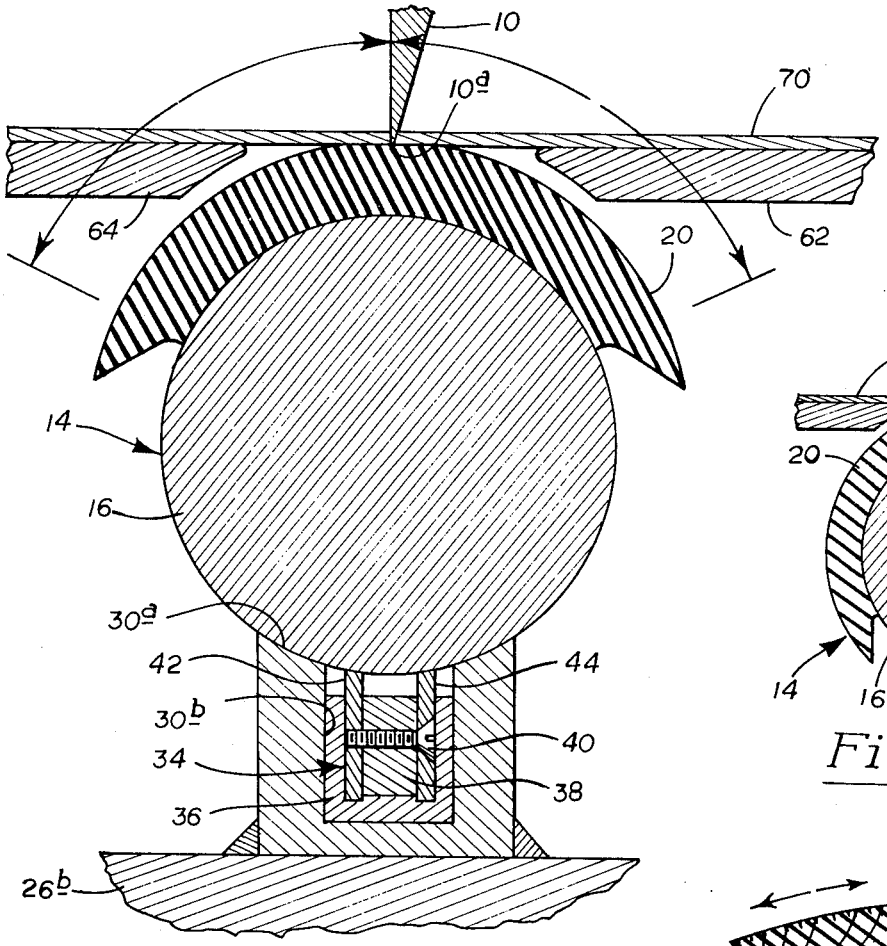
FIG. 2 is an enlarged cross-sectional view of an anvil and support cradle in the device taken generally along the line 2—2 in FIG. 1.

As is best seen in FIG. 2, the upper surface 30*a* of cradle 30 is machined to a concave radius conforming to the radius of the shaft 16. An elongate slot 30*b* extends longitudinally of cradle 30. Slot 30*b* may be either one continuous slot extending along the length of the cradle, or be a plurality of elongate slots spaced along the length of the cradle.

Elongate magnets, such as that indicated at 34, are secured in slot 30, as by being potted in an epoxy material 36. A magnet 34 includes an elongate permanent bar magnet 38, to the opposite sides of which are secured, as by screws 40, elongate bars 42, 44. The upper surfaces of bars 42, 44 are machined to concave radii conforming to the outer surface of shaft 16 and lie in a common arc with the upper surface 30*a* of cradle 30. With shaft 16 resting in cradle 30 as illustrated the magnetic force of permanent magnet 38 acting through bars 42, 44 holds the shaft firmly in the cradle.

Referring again to FIG. 1, opposite ends of shaft 16 are rotatably mounted in journals 50 secured to flange 26*b* of the beam.

Figure 4:
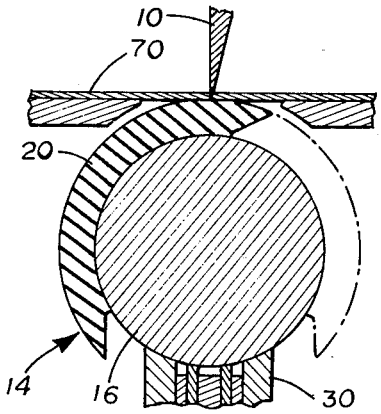
FIG. 4 is a view similar to FIG. 2, but on a reduced scale, indicating the degree of rotation possible for the anvil.

An elongate lever arm 52 is secured to the end of shaft 16 nearest the viewer in FIG. 1. An elongate, extensible-contractible screw mechanism 54 operated by a motor 56 is connected to arm 52 whereby extension of screw mechanism 54 rotates anvil 14 in a counterclockwise direction as seen in FIGS. 1 and 2 and retraction of the screw mechanism results in rotation of the anvil in a clockwise direction. In FIG. 4, the anvil is illustrated in solid outline rotated to what may be considered a counterclockwise limit position, and in dot-dashed outline is illustrated a limit position rotated in a clockwise direction.

As is seen in FIG. 1, the lower end of screw mechanism 54 and motor 56 are mounted on support 24 through a pivot connection 58 permitting pivoting of the screw mechanism and motor to accommodate changes in position to prevent binding as lever arm 52 is rotated about the axis of anvil 14.

Figure 5:
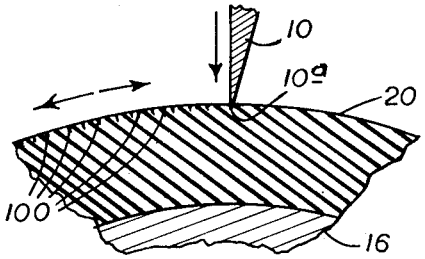
FIG. 5 is an enlarged view of the periphery of the resilient portion of the anvil illustrating random incremental rotation of the anvil to produce randomly spaced striking points on the anvil surface in the operation.

Referring still to FIGS. 1 and 2, conveyor mechanism is illustrated including horizontally disposed support plates 62, 64 on opposite sides of anvil 14 with the upper surfaces of the plates lying in a substantially common plane with the upper surface of the anvil. Intermediate laterally spaced plates 62 and intermediate laterally spaced plates 64 are power-driven conveyor belts 66. The plates and conveyor belts are operable to support a sheet of veneer as indicated at 70 in solid outline in FIG. 2 and dot-dashed outline in FIG. 1 and carry the same along a path between knife 10 and anvil 14 in the direction indicated by arrow 72 in FIG. 1. The drive for conveyors 66 is interruptible whereby veneer sheet 70 may be stopped with a desired section thereof between the knife and anvil. Upon shifting of the knife from its raised, or noncutting position illustrated in FIG. 1, to its cutting position as illustrated in FIGS. 2, 4 and 5 the knife is driven through veneer sheet 70 to cut the same and strikes the resilient surface of anvil 14.

A schematic illustration of the controls for actuating ram 12 for driving the knife between its cutting and noncutting positions and for operating motor 56 to produce rotation of anvil 14 is illustrated. As is seen in FIG. 6 hydraulic or pneumatic pressure fluid for actuating ram 12 is provided through hoses 74, 76 connected to a source of fluid pressure through a valve 77 operated by a solenoid 78. Valve 77 is such that in one position it produces shifting of the knife to its cutting position, in another position it produces retraction of the knife to its noncutting position, and in a neutral position holds the knife in its noncutting position. Other forms of drive mechanism for quickly shifting the knife between cutting and noncutting positions could be utilized also, for the sake of simplicity this style has been illustrated here.

The control circuit includes an electrical infeed line 80, a primary control circuit 82, a random pulse generator 84 and a safety interlock circuit 86. A line 90 interconnects an output terminal of control circuit 82 and solenoid 78. A line 94 interconnects another output terminal of control circuit 82 with an terminal of safety interlock circuit 86. Another line 94 interconnects another input terminal of interlock circuit and line 90. The output interminal of interlock circuit is connected through line 95 with the input terminal of pulse generator 84. A line 96 connects an output of pulse generator 84 with motor 56.

In such apparatus control circuit 82 is operable either to direct an operating signal to solenoid 78 to actuate ram 12 to shift the knife between its cutting and noncutting positions, or through line 92 to produce actuation of motor 56 to rotate anvil 14. Assuming a starting position with a sheet of veneer properly positioned and stopped for cutting under the knife, an energizing signal is provided by control circuit 82 through lines 90 to produce actuation of solenoid 78 to cause knife 10 to be shifted downwardly against anvil 14 to cut the veneer as illustrated in FIG. 2 and then return immediately to its noncutting position. The knife in striking of the face of the resilient portion of the anvil may slightly penetrate the resilient material or produce an effect which will somewhat roughen the surface. To extend the life of the resilient portion of the anvil it is caused to rotate slightly intermediate knife strokes to present a relatively new striking surface to the knife for the next cut.

Control circuit 82 is constructed to produce such rotation of the anvil by producing an operating signal through line 92 and pulse generator 84 to motor 56 when a cutting stroke of knife 10 is completed. Random pulse generator 84 may be of either a variable or preprogrammed type, whereby it produces varying length pulses of operating energy to motor 56. With such random length pulses being generated by the pulse generator the spacing between knife strikes on the surface of the anvil will vary, as indicated by the marks 100 in FIG. 5. Such random pattern of rotation of the anvil extends the life of the resilient portion of the anvil by presenting a different striking region to the knife each time it strikes. Explaining further, when the anvil is rotated in one direction the spacing between striking points on the anvil varies along the surface of the anvil, and on rotation of the anvil in the opposite direction the spacing again will be randomly varied whereby there is a substantially low probability of the knife striking the same point on the anvil repeatedly throughout operation of the device. Thus, the wear on the anvil will be spread substantially evenly over the surface of the anvil to extend its life.

Safety interlock circuit 86 is provided to assume that motor 56 will not be operated to produce a rotation of the anvil during a cutting stroke of the knofe. Explaining further, when circuit 82 is operable to produce actuation of solenoid 78 an operative signal is supplied through line 94 to interlock circuit 86. Interlock circuit 86 is constructed to prevent an operating signal from being transmitted to pulse generator 84 when the knife is performing a cutting stroke. When the operative signal to solenoid 78 terminates operation of knife 10 the signal through line 94 ceases and motor 56 may be actuated by a signal from pulse generator 84.

Since the lower surface of the anvil rests directly in contact with the upper surface of the cradle and is held firmly therein by the magnets, little, if any, rebound of the anvil from the underlying support occurs following knife cutting action and a more stable anvil surface is presented to the knife throughout operation.

It should be understood that the system also includes operator means for automatically reversing the sequence of rotation of anvil 14 when it has reached a limit position in either direction as illustrated, either in solid outline or in dot-dashed outline in FIG. 4. Thus, after motor 56 has rotated anvil 14 to its counterclockwise limit position, as illustrated in solid outline in FIG. 4, subsequent rotation will be in a clockwise direction until the limit position shown in dot-dash outline is reached, at which time it reverses again.

Figure 3:
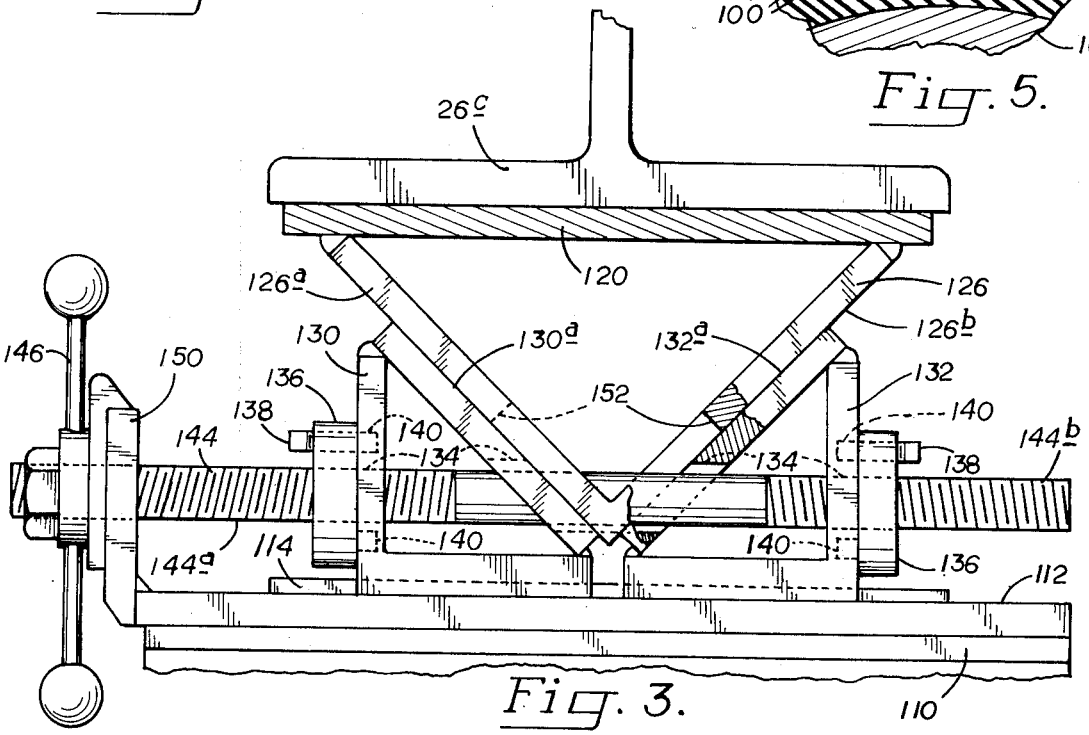
FIG. 3 is an enlarged cross-sectional view taken generally along the line 3—3 in FIG. 1 illustrating adjustment mechanism in the apparatus.

Referring to FIGS. 1 and 3 specifically, and further describing support 24 it includes a base such as that indicated generally at 110 at opposite ends of beam 24. Secured to base 110 is a horizontal plate 112 to the top of which is secured an elongate guide bar 114 extending substantially normal to the longitudinal axis of anvil 14.

Secured to and extending horizontally from the underside of web 26*c* of beam 26 is a horizontal plate 120. A screw jack 122 having an operating handle 124 extends between plates 112, 120 and upon actuation serves either to raise beam 26 and anvil 14 mounted thereon toward knife 10, or permits lowering of the support beam and anvil away from the knife. A similar screw jack positioned at the opposite end of beam 26 serves to raise and lower the opposite end.

Secured to the underside of plate 120 and spaced laterally inwardly from screw jack 122 is a support member 126 having oppositely facing, angularly disposed, face surfaces 126*a*, 126*b* facing away from anvil 14 (see FIG. 3).

Slidably mounted on plate 112 beneath support member 126 and guided by guide bar 114 are a pair of holding blocks, or members, 130, 132. These holding blocks have surfaces 130*a*, 132*a*, respectively, disposed at angles to the horizontal conforming to the angle of the face surfaces of support member 126. The support member rests on surfaces 130*a*, 132*a* of the holding blocks. Blocks 130, 132 have guideways formed in the underside thereof receiving guide bar 114, whereby they are permitted to slide only longitudinally of bar 114.

Each of blocks 130, 132 has a bore 134 extending horizontally therethrough. Each also has a collar 136 secured thereto by a screw, as indicated at 138. A plurality of threaded bores 140 in blocks 130, 132 are disposed about bores 134 whereby on release of screws 138 the angular positions of collars 136 may be changed relative to their respective holding blocks and then resecured to the blocks in their new positions.

An elongate screw 144 having a handle 146 secured thereto extends horizontally through the threaded bores of collars 136 and bores 134 in the holding blocks. The end portion of screw 144 illustrated at the left in FIGS. 1 and 3 is held in place relative to an upright support plate 150 secured to plate 112, whereby the screw 144 may rotate about its longitudinal axis on turning of handle 146, but does not shift longitudinally. Threads 144*a* at the left end of screw 144 are right-hand threads and threads 144*b* at the opposite end are left-hand threads. The threads in the bores of collars 136 are appropriately formed to receive the threads of screw 144.

A notch 152 in support member 126 receives screw 144 therethrough and is of sufficient depth to permit vertical shifting of the support member relative to the screw, as will be described below.

Should it become necessary to raise or lower anvil 14 this is easily accomplished with the mechanism just described. To raise the anvil screw jack 122 is operated to raise beam 26 to the position desired. As the beam is raised support member 126 raises from holding blocks 130, 132. To provide the desired support for beam 26 and the anvil mounted thereon as the beam is raised by screw jack 122 screw 144 is turned so that its threaded engagement with collars 136 produces simultaneous shifting of blocks 130, 132 toward each other and toward a common point therebetween until the blocks rest firmly against face surfaces 126*a*, 126*b* of support member 126. When the anvil is raised to the desired elevation and blocks 130, 132 are brought into firm facing engagement with faces 126*a*, 126*b* of holding member 126 a firm underlying support is provided for the anvil through beam 26 and cradle 30.

Should it be desired to lower anvil 14 for adjustment away from knife 10 it is a simple matter to turn screw 144 in the opposite direction to produce simultaneous shifting apart of holding blocks 130, 132 from a point therebetween to release the support of the holding blocks from support member 126. Thereafter screw jack 122 may be lowered to lower beam 26 and anvil 14 to the position desired. Blocks 130, 132 are then brought into contact with support member 126 to provide firm support therefor.

It may be necessary to shift anvil 14 laterally of the longitudinal axis of the anvil in an upstream or downstream direction relative to the path of the veneer conveyor. This may be done simply by releasing screws 138 whereby collars 136 may be rotated on screw 144, and rotating the collars on screw 144 to produce shifting of the holding members longitudinally of the screw and in the same direction to produce shifting of support beam 26 and anvil 14 supported thereon in the direction desired. Once the holding blocks have been shifted as desired longitudinally of screw 144, screws 138 again are used to fasten collars 136 to holding blocks 130, 132.

The operation of the apparatus of the invention should be fairly evident from the description set out above. Anvil 14 is initially set as desired relative to knife 10 by adjustment of screw jacks 122 and holding blocks 130, 132. By such adjustment both the vertical and lateral positioning of the anvil can be set as desired relative to knife 10.

Material, such as a sheet of veneer, is conveyed into a position between anvil 14 and knife 10. When the material is in a desired cutting position control circuit 82 actuates solenoid 78 to drive knife 10 into its cutting, or striking, engagement with the anvil to cut the material and then the knife retracts. After the knife is retracted from its cutting stroke control circuit 82 actuates pulse generator 84 to produce a random length pulse of operating energy to motor 56 to produce a small degree of rotation of anvil 14 to present a relatively new striking surface to knife 10 for the next knife stroke. After another knife stroke another random, or variable, length pulse of energy is provided to motor 56 to again slightly rotate the anvil in the same direction. Such rotation of the anvil intermediate cutting strokes of the knife continues until a limit position is reached in one rotative direction. Thereafter, the rotative direction of the anvil is reversed and like operation occurs in a reverse direction.

It should be evident also that since the anvil includes a substantially rigid cylindrical shaft supported throughout a major portion of its length in a continuous cradle having an upper surface configuration conforming to the arcuate lower surface of the anvil shaft a firm and stable support is provided for the anvil throughout operation. Further, the magnets secured in the cradle serve to hold the shaft firmly in the cradle to prevent rebound of the shaft following cutting strokes of the knife, while permitting rotation of the anvil within the cradle.

The support for the anvil, including a support member with angularly disposed surface faces and holding blocks which are shiftable toward and away from each other to provide support for the angularly disposed face surfaces of the support member permit a substantial degree of flexibility in adjusting the position of the anvil relative to the knife while providing firm and stable support for the anvil during operation.

While a preferred embodiment of the invention has been described herein, it should be apparent to those skilled in the art that variations and modifications are possible without departing from the spirit of the invention.

It is claimed and desired to secure by Letters Patent:

1. In cutting apparatus including a knife mounted for shifting between a cutting and a noncutting position, an anvil against which said knife may strike when shifted to its cutting position, said anvil including a magnetically attractable element having an arcuate lower surface facing away from said knife and a resilient arcuate striking surface facing generally in the direction of said knife, support means for said anvil including a cradle in which the lower surface of said element rests and magnet means magnetically attracting said element to hold it in said cradle, and rotator means operatively connected to said anvil operable on actuation to rotate the anvil in said cradle to present different portions of said arcuate striking surface to the knife.

2. The apparatus of claim 1, wherein said element comprises a rigid member and said resilient striking surface comprises a covering of resilient material secured to an upper portion only of said element, whereby the lower surface of said element rests in direct contact with said cradle.

3. The apparatus of claim 1, which further comprises operator means operable to produce random angular incremental rotation of said anvil intermediate cutting strokes of said knife.

4. The apparatus of claim 3, wherein said operator means comprises motor operatively connected to said anvil for producing rotation of the anvil on actuation of said motor means and means for supplying random length pulses of operating energy to said motor means.

5. The apparatus of claim 1, wherein said element comprises an elongate metal shaft, and said cradle is elongate and has a surface configuration facing said anvil which substantially conforms to the lower surface configuration of said shaft to support the shaft throughout a major portion of its length for rotation about its longitudinal axis.

6. The apparatus of claim 5, wherein said magnet means comprises a magnet disposed in said cradle to contact and hold the shaft.

7. The apparatus of claim 1, which further comprises adjustment means operatively connected to said support means for shifting the support and anvil relative to said knife and holding them in a selected adjusted position, said adjustment means comprising a support member having a pair of oppositely facing, angularly disposed, face surfaces, a pair of holding blocks having surfaces disposed at angles conforming to said face surfaces of said support member, on which blocks said support member rests, and shifting means for shifting said holding blocks toward and away from each other against said face surfaces of said support member and for retaining said holding blocks in selected adjusted positions relative to each other.

8. The apparatus of claim 7, wherein said shifting means comprises means for shifting the holding blocks in opposite directions simultaneously toward or away from a reference point therebetween and which further comprises translation means for shifting said holding blocks in the same direction to produce movement of said support laterally of said knife.

9. The apparatus of claim 8, wherein said shifting means comprises elongate screw means operatively connected to said holding blocks in such a manner that turning of said screw means in one direction produces shifting of said holding blocks toward each other and turning of the screw means in the opposite direction produces shifting apart of said holding blocks.

10. The apparatus of claim 8, wherein said translation means comprises means for moving said holding blocks along said screw means independently of turning of said screw means.

11. In cutting apparatus including a knife mounted for shifting between a cutting and a noncutting position, an anvil against which said knife may strike when shifted to its cutting position, said anvil including an element having an arcuate striking surface facing generally in the direction of said knife, support means mounting said anvil for rotation about an axis extending substantially parallel to the axis of curvature of said striking surface, and rotator means operatively connected to said anvil operable on actuation to rotate the anvil to present different portions of said arcuate striking surface to the knife, said rotator means being operable to produce varying, angular, incremental rotation of said anvil intermediate cutting strokes of said knife.

12. The apparatus of claim 11, wherein said rotator means comprises motor means operatively connected to said anvil for producing rotation of the anvil on actuation of the motor means and means for supplying random pulses of operating energy to said motor means.

13. The apparatus of claim 11, wherein said anvil further comprises a resilient arcuate covering secured to the striking surface of said anvil.

14. In cutting apparatus including an elongate knife having an elongate cutting edge thereon mounted for shifting between a cutting and a noncutting position, an anvil against which said knife may strike when shifted to its cutting position, said anvil including an elongate, magnetically attractable member extending substantially parallel to said knife edge, said member having an arcuate surface facing away from said knife and having a resilient arcuate striking surface facing generally in the direction of said knife.

support means for said anvil including an elongate cradle extending substantially parallel to said member having a surface configuration facing said member which substantially conforms to the arcuate surface of said member facing away from said knife, in which cradle said member rests for rotation about its longitudinal axis, and magnet means magnetically attracting said member to hold it in said cradle, and rotator means operatively connected to said anvil operable on actuation to rotate the anvil in said cradle to present different portions of said striking surface to the knife.

15. The apparatus of claim 14, wherein said magnet means comprises a magnet secured in said cradle in a position to contact and hold said member.

16. The apparatus of claim 14, wherein said member comprises an elongate rigid shaft and said resilient striking surface comprises a covering of resilient material secured only to a portion of said shaft facing generally in the direction of said knife with the opposite facing surface of said shaft resting in direction contact with said cradle.

17. The apparatus of claim 14, which further comprises adjustment means operatively connected to said support means for shifting the latter relative to said knife and holding the same in a selected adjusted position relative to the knife, said adjustment means comprising a support member having a pair of oppositely facing, angularly disposed face surfaces facing generally away from said knife, a pair of holding blocks having surfaces disposed at angles conforming to said opposite face surfaces of said support member, and shifting means for shifting said holding blocks toward and away from each other against said face surfaces of said support member and for retaining said holding blocks in selected adjusted positions relative to each other.

18. The apparatus of claim 17, wherein said shifting means comprises means for simultaneously shifting the two holding blocks toward or away from a reference point therebetween and which further comprises translation means for shifting said holding blocks either simultaneously or independently in the same direction laterally of the longitudinal axis of said knife to produce movement of the support means and anvil in a direction laterally of the longitudinal axis of the knife.

19. The apparatus of claim 18, wherein said shifting means comprises elongate screw means operatively connected to said holding blocks in such a manner that turning of said screw means in one direction produces shifting of said holding blocks toward each other and turning in the opposite direction produces shifting apart of said holding blocks, and said translation means comprises means for moving said holding blocks along said screw means independently of turning of said screw means.

20. The apparatus of claim 14, wherein said cradle has a continuous supportive surface extending longitudinally thereof to provide support for such member throughout a major portion of its length.

* * * * *

UNITED STATES PATENT AND TRADEMARK OFFICE

CERTIFICATE OF CORRECTION

PATENT NO. : 3,975,976

DATED : August 24, 1976

INVENTOR(S) : Thomas H. Prentice

It is certified that error appears in the above–identified patent and that said Letters Patent are hereby corrected as shown below:

Column 8, line 34, insert --means-- after "motor"

Column 10, line 15, "direction" should be --direct--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*